US012415117B1

(12) United States Patent
Pan et al.

(10) Patent No.: US 12,415,117 B1
(45) **Date of Patent: *Sep. 16, 2025**

(54) GOLF CLUB HEAD WITH REINFORCED BENDABLE HOSEL

(71) Applicant: Topgolf Callaway Brands Corp., Carlsbad, CA (US)

(72) Inventors: Yaming Pan, Vista, CA (US); Nathan Reed, San Diego, CA (US); Denver Holt, Carlsbad, CA (US); James A. Seluga, Carlsbad, CA (US); Matthew Myers, Carlsbad, CA (US)

(73) Assignee: Topgolf Callaway Brands Corp., Carlsbad, CA (US)

( * ) Notice: Subject to any disclaimer, the term of this patent is extended or adjusted under 35 U.S.C. 154(b) by 24 days.

This patent is subject to a terminal disclaimer.

(21) Appl. No.: 18/367,257

(22) Filed: Sep. 12, 2023

Related U.S. Application Data

(63) Continuation of application No. 17/874,796, filed on Jul. 27, 2022, now Pat. No. 11,752,399.

(60) Provisional application No. 63/227,036, filed on Jul. 29, 2021.

(51) Int. Cl.
*A63B 53/02* (2015.01)
*A63B 53/04* (2015.01)

(52) U.S. Cl.
CPC ..... *A63B 53/02* (2013.01); *A63B 53/0412* (2020.08); *A63B 53/0437* (2020.08); *A63B 53/045* (2020.08); *A63B 53/0466* (2013.01); *A63B 2209/00* (2013.01)

(58) Field of Classification Search
CPC . A63B 53/02; A63B 53/0412; A63B 53/0437; A63B 53/0466; A63B 53/045; A63B 2209/00
USPC ..... 473/305–315
See application file for complete search history.

(56) References Cited

U.S. PATENT DOCUMENTS 5,482,279 A * 1/1996 Antonious ..... A63B 60/00 473/328
6,186,903 B1 * 2/2001 Beebe ..... A63B 53/04 473/305
6,926,616 B1 * 8/2005 Kusumoto ..... A63B 53/02 473/305
6,997,818 B2 * 2/2006 Kouno ..... A63B 53/0466 473/305
7,241,229 B2 * 7/2007 Poyno ..... A63B 53/0466 473/309
7,749,095 B2 * 7/2010 Nishitani ..... A63B 53/04 473/305
7,846,037 B2 * 12/2010 Burnett ..... A63B 60/00 473/307
8,323,121 B2 * 12/2012 Wada ..... A63B 53/0466 473/346
8,561,876 B2 * 10/2013 Yamamoto ..... B23P 11/00 228/178
9,144,718 B2 * 9/2015 Johnson ..... A63B 60/00
(Continued)

*Primary Examiner* — Sebastiano Passaniti
(74) *Attorney, Agent, or Firm* — Michael A. Catania

(57) ABSTRACT

A golf club head with hosel reinforcement structures arrayed around a hosel axis and extending from an inner mold line of the golf club head within a reinforcement region is disclosed herein. The reinforcement structures include ribs and scallops, which are arranged in specific positions within the reinforcement region to maximize hosel bendability without sacrificing the structural integrity of the golf club head.

14 Claims, 4 Drawing Sheets

(56) References Cited

U.S. PATENT DOCUMENTS 9,522,308 B2 * 12/2016 Sander ..... A63B 53/02
9,526,953 B2 * 12/2016 Cackett ..... A63B 53/02
9,776,058 B2 * 10/2017 Seluga ..... A63B 53/04
9,849,348 B2 * 12/2017 Beach ..... A63B 60/00
10,076,687 B2 * 9/2018 Hall ..... A63B 53/0466
10,258,846 B1 * 4/2019 Nunez ..... A63B 53/0466
10,363,469 B2 * 7/2019 Beach ..... A63B 60/00
10,589,154 B2 * 3/2020 Seluga ..... A63B 53/06
10,716,980 B2 * 7/2020 Myers ..... A63B 53/0408
11,752,399 B1 * 9/2023 Pan ..... A63B 53/0412
473/305
2005/0085313 A1 * 4/2005 Nishitani ..... A63B 53/0466
473/305
2008/0146375 A1 * 6/2008 Nakano ..... A63B 53/04
473/345
2009/0042665 A1 * 2/2009 Morales ..... A63B 53/02
473/347
2010/0099512 A1 * 4/2010 Chen ..... A63B 53/02
473/305
2010/0255929 A1 * 10/2010 Soracco ..... G01N 29/045
473/345
2011/0312437 A1 * 12/2011 Sargent ..... A63B 53/06
473/335
2012/0058839 A1 * 3/2012 De La Cruz ..... A63B 53/04
473/345
2012/0115632 A1 * 5/2012 Cackett ..... A63B 53/02
473/305
2013/0190103 A1 * 7/2013 Rice ..... A63B 53/02
473/324
2013/0320072 A1 * 12/2013 Yamamoto ..... A63B 53/0466
228/212
2014/0100055 A1 * 4/2014 Cackett ..... A63B 53/02
473/305
2018/0214747 A1 * 8/2018 Holtzman ..... A63B 53/02
2018/0345093 A1 * 12/2018 Harbert ..... A63B 53/0466

* cited by examiner

GOLF CLUB HEAD WITH REINFORCED BENDABLE HOSEL

CROSS REFERENCES TO RELATED APPLICATIONS

The present application is a continuation application of U.S. patent application Ser. No. 17/874,796, filed on Jul. 27, 2022, now U.S. patent Ser. No. 11/752,399, which claims priority to U.S. Provisional Patent Application No. 63/227,036, filed on Jul. 29, 2021, the disclosure of each is hereby incorporated by reference herein.

STATEMENT REGARDING FEDERALLY SPONSORED RESEARCH OR DEVELOPMENT

Not Applicable

BACKGROUND OF THE INVENTION

Field of the Invention

The present invention relates to a hollow golf club head, and particularly a fairway wood-type golf club head, with a reinforced hosel that can be bent easily without damaging any portion of the golf club head.

Description of the Related Art

Hosel bendability is a desirable feature for golf club heads because it allows the club heads to be customized to specific golfers. When a golf club is fitted to a particular golfer, the lie, loft, and/or face angle of the golf club may be adjusted by bending the hosel portion of the club.

Some prior art methods of achieving such bendability have focused on material properties. In these processes, hosels are created from a ductile material, softened via heat treatment (as disclosed in U.S. patent Ser. No. 10/486,223), or bent at high temperatures. Such processes are generally complex, require tedious trial and error processes, and must be performed before the golf club is finished cosmetically. Furthermore, when hosels are made from softer materials, it is harder to control their bendability properties. They will not have the desired robustness and simultaneous feedback necessary to support such bending processes, and will have varying compliance and resistance from the bending angle.

Other prior art means of obtaining bendability have focused on external geometric features that distribute bending stresses and control strain locations. Some examples include the notch designs disclosed in U.S. Pat. Nos. 6,186,903 and 9,849,348.

While these designs solve for some of the issues presented by the material properties processes, they do not substantially improve hosel bendability and their benefits are limited by aerodynamic and cosmetic considerations.

Therefore, there is a need for a golf club head with an improved, bendable hosel design.

BRIEF SUMMARY OF THE INVENTION

One aspect of the present invention is a hollow golf club head with hosel reinforcement regions that are hidden from view of a golfer, which provides a more cosmetically appealing product with improved bendability characteristics that reduce the human effort involved in bending process.

This hosel reinforcement region comprises ribs and thickness pads or scallops, the thickness of which may be optimized using AI.

Another aspect of the present invention is a golf club head comprising a body comprising a face section, a crown section, a sole section, a hosel, an interior cavity, a flange where the hosel blends into the crown section, face section, and sole section, a reinforcement region proximate the flange, and a volume of 50 to 300 cubic centimeters, at least one rib, and at least one scallop, wherein the hosel comprises a hosel bore with a hosel axis and a hosel embedment where the hosel extends into the interior cavity, wherein each of the at least one rib and the at least one scallop is confined to the reinforcement region, wherein, when a coordinate system is applied to the body and centered around the hosel axis, 0° and 180° positions extend parallel with the face section and 90° and 270° positions extend perpendicular to the face section, with the 270° position extending in a forward direction away from the face section, and wherein the at least one rib extends from the hosel embedment onto an inner surface of the crown section and is disposed between the 90° and 180° positions of the coordinate system.

In some embodiments, the reinforcement region may be a volcano-shaped region comprising all body surfaces contained within a cylinder with a diameter of 1 to 2.5 inches that is applied around the hosel axis at the flange. In other embodiments, the reinforcement region may be a volcano-shaped region located between the flange and the face section, sole section, and crown section. In other embodiments, the golf club head may comprise a face component, the face section may comprises a face opening, and the face component may be affixed to the body to cover the face opening. In a further embodiment, the face component may be selected from a group consisting of a face cup and a face insert. In still other embodiments, the golf club head may comprise a crown insert, the crown section and the sole section may define an upper opening, the crown section may comprise an attachment zone, and the crown insert may be affixed to the body to cover the upper opening. In a further embodiment, the crown insert may be composed of a non-metal material, the body may be composed of a metal material, and the crown insert may be affixed to the attachment zone with an adhesive material.

In other embodiments, the crown section may comprises thickened region that extends in a heel to toe direction, and the at least one rib may extend from the hosel embedment to the thickened region. In still other embodiments, the at least one scallop may have a thickness of 0.001 to 0.100 inch, and in other embodiments the at least one scallop may not be disposed between the 225° and 270° positions of the coordinate system. In still other embodiments, the at least one scallop may comprise a first scallop and a second scallop, and the first scallop may have a greater area than the second scallop. In a further embodiment, the first scallop may be aligned with one of the 0°, 90°, 180°, and 270° positions within the coordinate system, and the second scallop may be aligned with one of 45°, 135°, 225°, and 315° positions within the coordinate system.

In other embodiments, the at least one rib may extend over the at least one scallop. In another embodiment, the body may have an average thickness of approximately 0.032 inch. In yet another embodiment, each of the at least one rib and the at least one scallop may be spaced from and does not make contact with the face section. In any of the embodiments, the at least one rib may have an approximately triangular cross-sectional shape, a thickness of 0.030 to 0.090 inch, and/or a height that is greater than or equal to the depth of the hosel embedment. In any of the embodiments, the at least one rib may comprise three ribs.

Yet another aspect of the present invention is a fairway wood type golf club head comprising a metal body comprising a face section, a crown section, a sole section, an upper opening defined by the crown section and the sole section, a face opening in the face section, a hosel, an interior cavity, a flange where the hosel blends into the crown section, face section, and sole section, and a volcano-shaped reinforcement region proximate the flange, a composite crown insert affixed to the body at an attachment zone in the crown section to close the upper opening, a metal face component comprising a striking portion, the face component affixed to the body to cover the face opening, at least one rib, and at least one scallop, wherein the hosel comprises a hosel bore with a hosel axis and a hosel embedment where the hosel extends into the interior cavity, wherein each of the at least one rib and the at least one scallop is confined to the reinforcement region, wherein, when a coordinate system is applied to the body and centered around the hosel axis, 0° and 180° positions extend parallel with the face section and 90° and 270° positions extend perpendicular to the face section, with the 270° position extending in a forward direction away from the face section, wherein the at least one rib extends from the hosel embedment to the attachment zone and is disposed between the 900 and 180° positions of the coordinate system, and wherein the at least one scallop is aligned with one of the 0°, 90°, 180°, and 270° positions of the coordinate system.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
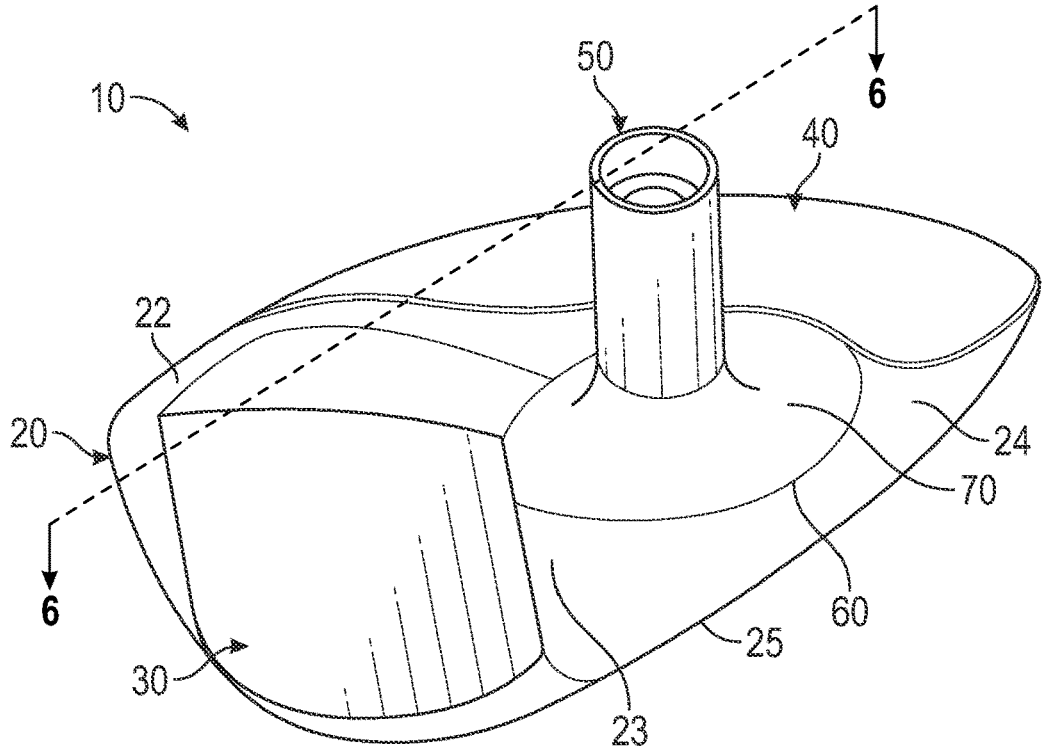
FIG. 1 is a perspective view of a golf club head of the present invention.

The present invention is directed to a golf club head, and particularly a hollow fairway wood head, with stiffening structures disposed within a hosel reinforcement region proximate the flange where the hosel connects with the body. Though the preferred embodiment is a fairway wood, the structures disclosed herein may be applied to other hollow golf club heads, including drivers, hybrids, irons, and putters.

A preferred embodiment of this invention is shown in FIGS. 1-8. In this embodiment, the golf club head 10 has a body 20, a face cup 30, a crown insert 40, and a hosel 50. The hosel 50 may be integrally formed (e.g., cast, formed, forged) with the body 20, or may be manufactured separately and then affixed to the body 20 using any means known to a person skilled in the art. The body 20 has an average thickness of 0.032 inch to maximize discretionary mass. In other embodiments, the golf club head 10 may have a face insert instead of a face cup 30, and the crown portion may be integrally cast, forged, formed, etc. with the body so that there is no need for a separate crown insert 40. In still other embodiments, the striking face 32 may be integrally cast, forged, formed, etc. with the body so that there is no need for a separate face cup 30 or face insert.

The region where the hosel 50 attaches to or blends into the body 20 is known as the flange 60, and that is where the novel reinforcement region 70 is at least partially disposed. The reinforcement region 70 may be defined by drawing a 1.0 inch to 2.5 inch diameter cylinder around the hosel axis 55 at the flange 60 and applying the reinforcement structures 80 described below to the surfaces of the flange 60, hosel 50, and body 20 (particularly the crown region 22 and ribbon or edge region 24 of the body 20) that fall within that cylinder. Alternatively, the reinforcement region 70 may be defined by starting from the end of the constant diameter of the bottom of the hosel 50 (i.e., at the flange 60), and extending to (and being confined by) the surface 28 to which the crown insert 40 is attached at the crown region 22, the face region 23, and the edge region 24. The resulting reinforcement region 70 looks like a volcano when applied to a wood-type golf club head 10, as illustrated in FIGS. 2-4.

Figure 2:
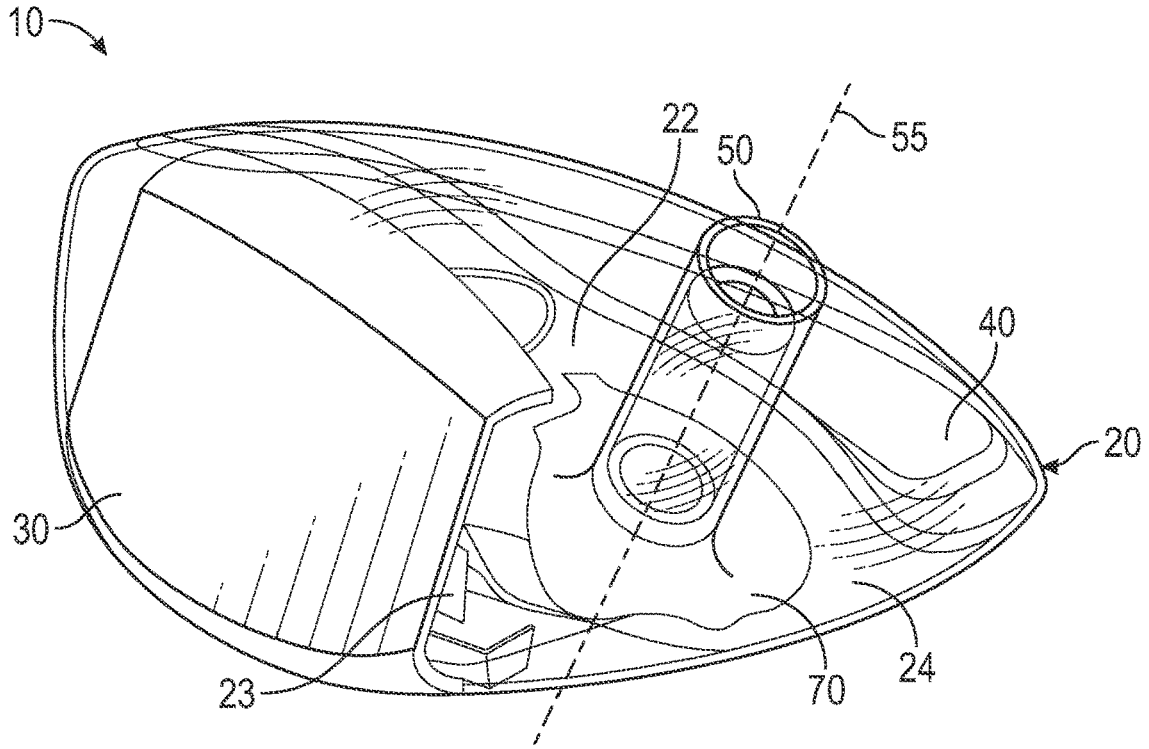
FIGS. 2-3 are partially transparent views of the embodiment shown in FIG. 1.
Figure 3:
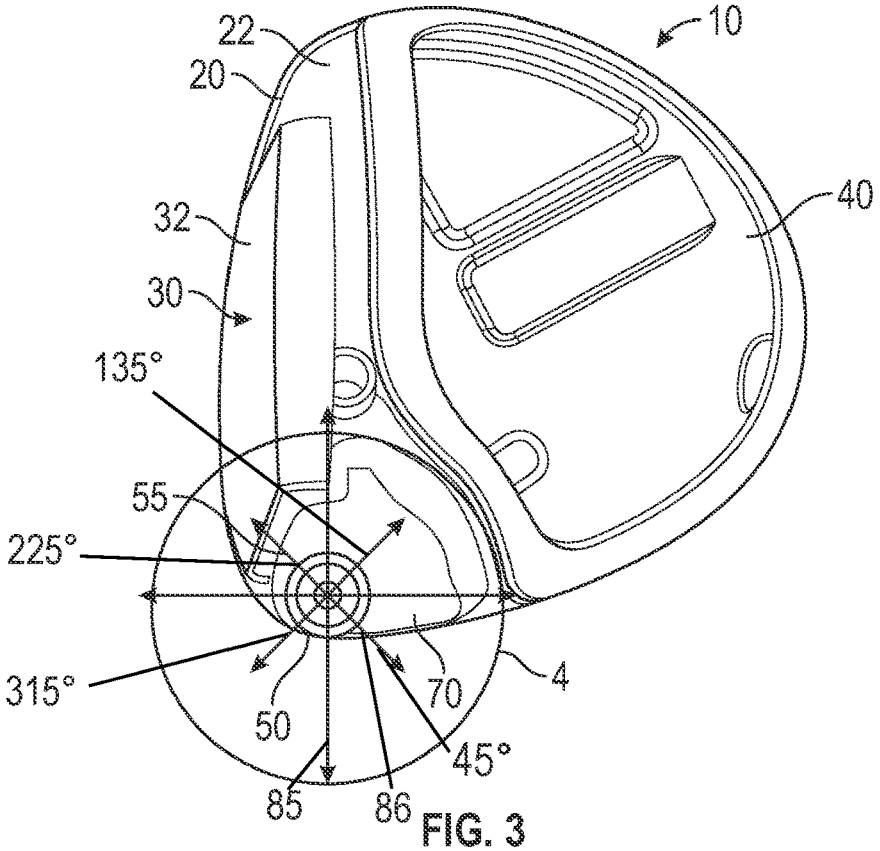
Figure 4:
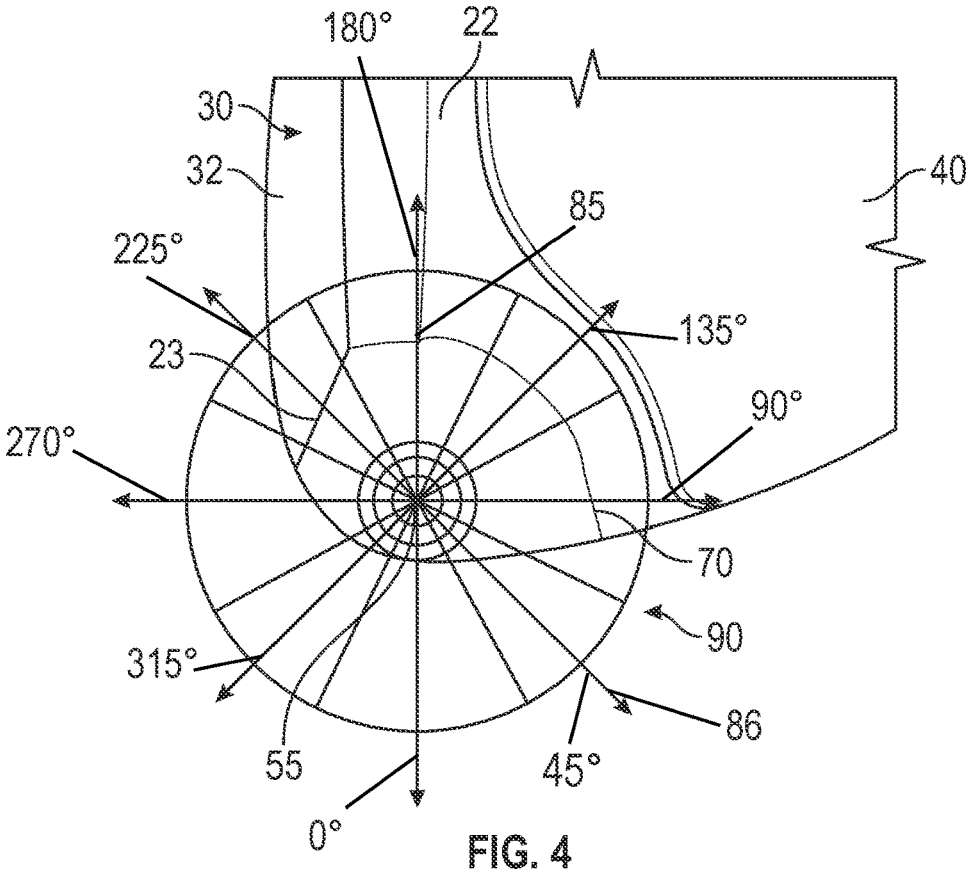
FIG. 4 is an enlarged view of the circled portion of the embodiment shown in FIG. 3.
Figure 5:
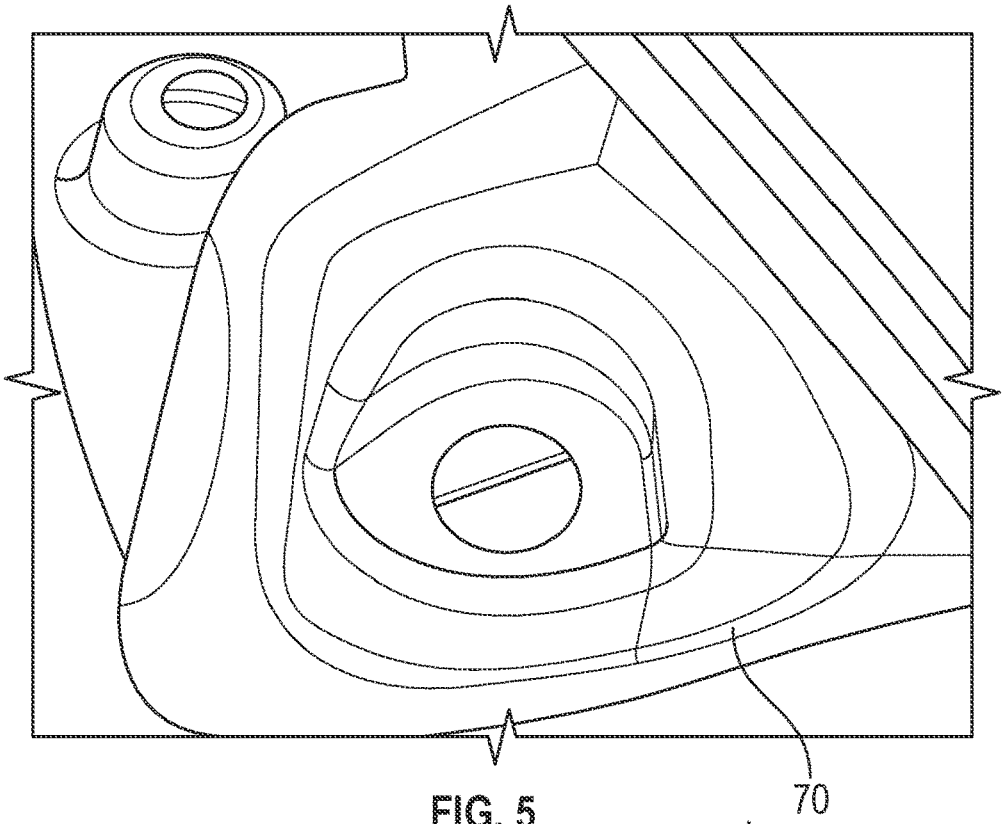
FIG. 5 is an enlarged, perspective view of the reinforcement region shown in FIGS. 2-4.

With reference to FIGS. 2-4, a two-dimensional polar coordinate system of bending direction 90, defined by a center coincident with the hosel axis 55, is applied to the golf club head 10 to create eight independent areas approximately corresponding to eight bending directions based on the inner mold line (IML) features of the golf club head 10 and CAD surface edges, with the 270° position parallel with the square direction of the striking portion 32. According to this coordinate system 90, 0° is flat (negative lie angle), 90° is strong (negative loft angle), 180° is upright (positive lie angle), and 270° is weak (positive loft angle). This coordinate system 90 is used to define the distribution of reinforcement structures 80 to maximize their support function without adding an unnecessary amount of mass to the golf club head 10.

The reinforcement structures 80 of the present invention comprise a plurality of ribs 82 and scallops or thickness pads 84, all of which are disposed within the "volcano" reinforcement region 70 and are applied to the IML of the golf club head 10. These structures 80 are spaced slightly from the face region 23 so as to avoid affecting the variable face thickness pattern on the striking portion 32 of the face cup 30, and do not extend to the sole 25 of the body 20 beneath the hosel 50.

Figure 6:
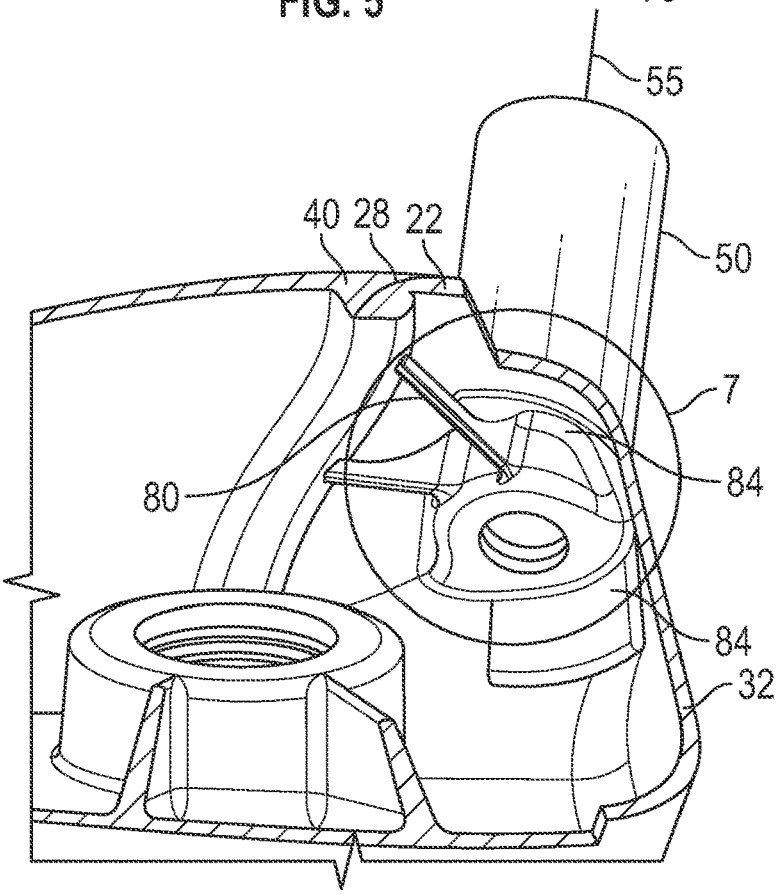
FIG. 6 a cross-sectional view of the embodiment shown in FIG. 1 taken along lines 6-6.
Figure 7:
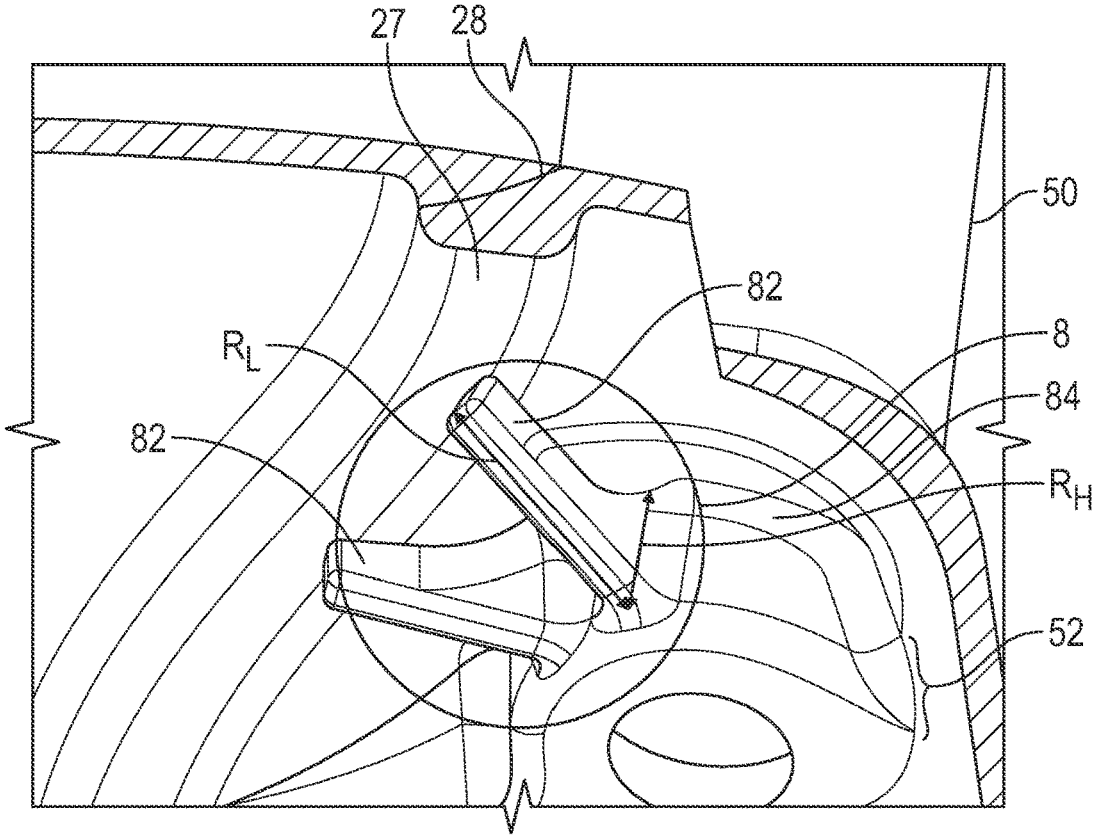
FIG. 7 is an enlarged view of the circled portion of the embodiment shown in FIG. 6.
Figure 8:
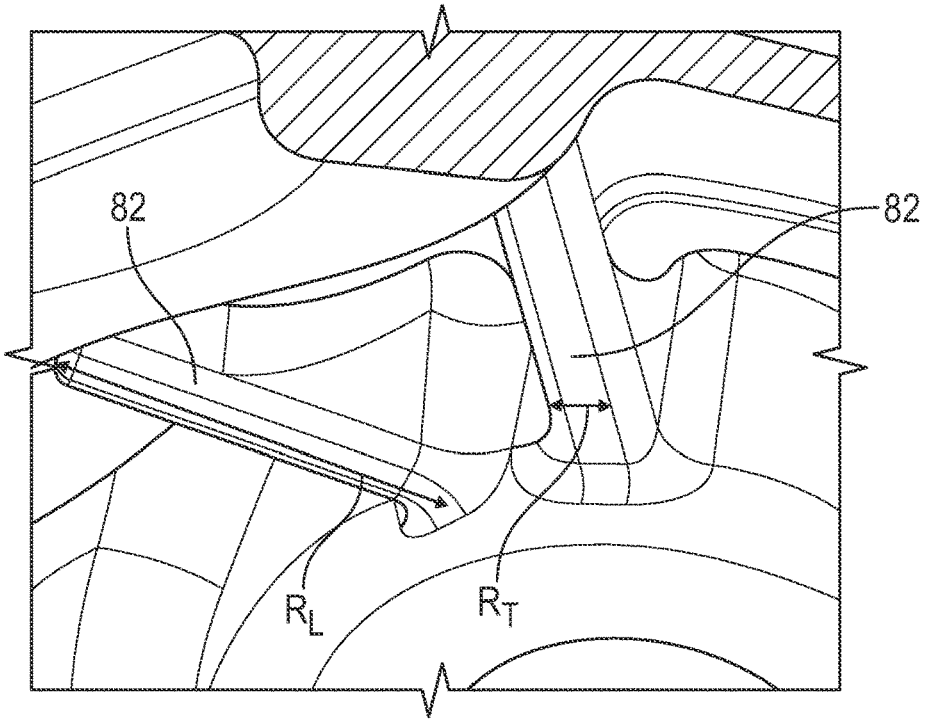
FIG. 8 is an enlarged view of the circled portion of the embodiment shown in FIG. 7.

As shown in FIGS. 6-8, the ribs 82 of the present invention have a narrow, triangular geometry or cross-sectional shape, and bridge the embedded portion 52 of the hosel 50 (also known as the hosel embedment) and the volcano reinforcement region 70. There are preferably two or three ribs 82 with a thickness $R_T$ ranging between 0.030 and 0.090 inch, a top-to-bottom height RH that is greater than or equal to hosel embedment 52, and a length $R_L$ that varies depending on the distance between the hosel embedment 52 and the surface 28 at which the crown insert 40 is affixed to the crown region 22 or a thickened region 27 where stiffening or stress-reducing members, such as those disclosed in U.S. Pat. Nos. 9,776,058, 9,987,167, 10,258,846, 10,589,154, and 10,716,980, the disclosure of each of which is hereby incorporated by reference in its entirety herein, are affixed to the crown region 22. The ribs 82, which do not extend above the top of the hosel embedment 52, are placed in the reinforcement region 70 between the 90° and 180° coordinates.

The scallops 84 of the present invention are also shown in FIG. 6. These structures are roughly split into 350 and 550 "pie slices", with 55° slices 85 applied to the major bending directions (0°, 90°, 180°, and 270°) and 350 slices 86 applied along the minor directions (45°, 135°, 225°, and 315°). The larger slices 85 are oriented along the major directions so that their bending angles can satisfy optimization restraints. The eight independent areas defined by the coordinate system 90 are placeholders for the scallops 84, the thickness of which (in the event a scallop is placed there instead of being left empty) varies from 0.0001 to 0.100 inch. Preferably, no scallops 84 are placed in the 225° to 270° areas to avoid affecting the variable face thickness of the striking region 32 of the face cup 30.

Ribs 82 are also placed at the shared boundaries between scallops 84 for easier meshing and manufacturing, and may be applied on top of the scallops 84. There also is no material infill (and no reinforcement structures 80) between the hosel embedment 52 and the volcano reinforcement region 70. This configuration reduces or eliminates out-of-shape failure or buckling due to structural instability or paint cracking above the crown adhesive (where the crown insert 40 connects to the crown region 22 of the body 20) when the hosel 50 is bent toward the crown insert 40. If no crown insert 40 is used and the crown is integrally created (e.g., cast) with the body 20, this configuration helps reduce buckling.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. The section titles included herein also are not intended to be limiting. Therefore, the embodiments of the invention in which an exclusive property or privilege is claimed are defined in the following appended claims.

We claim:

1. A wood-type golf club head comprising:

a body comprising a face section, a crown section, a sole section, a hosel, an interior cavity, a flange that blends the hosel into the crown section, face section, and sole section, a reinforcement region proximate the flange, and a volume of 50 to 300 cubic centimeters;

at least one rib; and wherein the hosel comprises a hosel bore with a hosel axis and a hosel embedment, wherein the hosel embedment extends into the interior cavity below the flange;

wherein, when a coordinate system is applied to the body and centered around the hosel axis, 0° and 180° positions extend parallel with the face section and 90° and 270° positions extend perpendicular to the face section, with the 0° position extending in a heelward direction away from a heel section, the 180° position extending in a toeward direction away from a toe section, the 90° position extending in a rearward direction away from the face section, and the 270° position extending in a forward direction away from the face section;

wherein the at least one rib extends from the hosel embedment onto an inner surface of the crown section and is disposed exclusively between the 90° and 180° positions of the coordinate system;

wherein the crown section comprises a thickened region that extends in a heel to toe direction, and wherein the at least one rib extends from the hosel embedment to the thickened region.

2. The golf club head of claim 1, further comprising a face component, wherein the face section comprises a face opening and wherein the face component is affixed to the body to cover the face opening.

3. The golf club head of claim 2, wherein the face component is selected from a group consisting of a face cup and a face insert.

4. The golf club head of claim 1, wherein the body has an average thickness of approximately 0.032 inch.

5. The golf club head of claim 1, wherein the at least one rib has a thickness of 0.030 to 0.090 inch.

6. The golf club head of claim 1, wherein the at least one rib has a height that is greater than or equal to a depth of the hosel embedment.

7. The golf club head of claim 1, wherein the at least one rib comprises three ribs.

8. A wood-type golf club head comprising:

a body comprising a face section, a crown section, a sole section, a hosel, an interior cavity, a flange that blends the hosel into the crown section, face section, and sole section, a reinforcement region proximate the flange, and a volume of 50 to 300 cubic centimeters;

at least one rib; and at least one scallop;

wherein the hosel comprises a hosel bore with a hosel axis and a hosel embedment, wherein the hosel embedment extends into the interior cavity below the flange;

wherein, when a coordinate system is applied to the body and centered around the hosel axis, 0° and 180° positions extend parallel with the face section and 90° and 270° positions extend perpendicular to the face section, with the 0° position extending in a heelward direction away from a heel section, the 180° position extending in a toeward direction away from a toe section, the 90° position extending in a rearward direction away from the face section, and the 270° position extending in a forward direction away from the face section;

wherein the at least one rib extends from the hosel embedment onto an inner surface of the crown section and is disposed exclusively between the 90° and 180° positions of the coordinate system;

wherein the at least one scallop has a thickness of 0.001 to 0.100 inch, and wherein the at least one scallop is not disposed between the 225° and 270° positions of the coordinate system.

9. The golf club head of claim 8, further comprising a second scallop, wherein the at least one scallop has a greater area than the second scallop.

10. The golf club head of claim 9, wherein the at least one scallop is aligned with one of the 0°, 90°, 180°, and 270° positions within the coordinate system.

11. The golf club head of claim 9 wherein the second scallop is aligned with one of 45°, 135°, 225°, and 315° positions within the coordinate system.

12. The golf club head of claim 8, wherein the at least one rib extends over the at least one scallop.

13. The golf club head of claim 8, wherein each of the at least one rib and the at least one scallop is spaced from and does not make contact with the face section.

14. A wood-type golf club head comprising:

a body comprising a face section, a crown section, a sole section, a hosel, an interior cavity, a flange that blends the hosel into the crown section, face section, and sole section, a reinforcement region proximate the flange, and a volume of 50 to 300 cubic centimeters; and at least one rib;

wherein the hosel comprises a hosel bore with a hosel axis and a hosel embedment, wherein the hosel embedment extends into the interior cavity below the flange;

wherein, when a coordinate system is applied to the body and centered around the hosel axis, 0° and 180° positions extend parallel with the face section and 90° and 270° positions extend perpendicular to the face section, with the 0° position extending in a heelward direction away from a heel section, the 180° position extending in a toeward direction away from a toe section, the 90° position extending in a rearward direction away from the face section, and the 270° position extending in a forward direction away from the face section;

wherein the at least one rib extends from the hosel embedment onto an inner surface of the crown section and is disposed exclusively between the 90° and 180° positions of the coordinate system;

wherein the at least one rib has an approximately triangular cross-sectional shape.

* * * * *